United States Patent [19]

Murayama

[11] 4,284,023

[45] Aug. 18, 1981

[54] METHOD OF PRODUCING AN EASILY OPENABLE CONTAINER CLOSURE HAVING A SHELL AND A SEALING MEMBER

[75] Inventor: Kashiwa Murayama, Fujisawa, Japan

[73] Assignee: Japan Crown Cork Co., Ltd., Tokyo, Japan

[21] Appl. No.: 66,465

[22] Filed: Aug. 13, 1979

Related U.S. Application Data

[62] Division of Ser. No. 16,606, Mar. 1, 1979, Pat. No. 4,197,956.

[30] Foreign Application Priority Data

| | | | |
|---|---|---|---|
| Mar. 3, 1978 | [JP] | Japan | 53-23544 |
| Apr. 5, 1978 | [JP] | Japan | 53-39278 |
| Aug. 11, 1978 | [JP] | Japan | 53-97286 |

[51] Int. Cl.[3] ..... B21D 51/26

[52] U.S. Cl. ..... 113/116 QA; 113/120 Q; 113/121 C

[58] Field of Search ..... 113/116 QA, 116 CC, 113/120 R, 120 Q, 121 R, 121 A, 121 C; 215/254

[56] References Cited

U.S. PATENT DOCUMENTS

| | | | |
|---|---|---|---|
| 3,195,756 | 7/1965 | Luviano | 215/254 |
| 3,920,142 | 11/1975 | Vandrebeck | 215/254 |
| 3,963,141 | 6/1966 | Liu | 215/254 |
| 4,003,488 | 1/1977 | Moller | 215/254 |

*Primary Examiner*—Howard N. Goldberg

*Attorney, Agent, or Firm*—Wenderoth, Lind & Ponack

[57] ABSTRACT

A method of producing an easily openable container closure which has (1) a shell of with unitary structure including a top and cylindrical skirt, the top having an annular top surface portion leading to the upper end of the skirt and a pull ring connected to a part of the inner peripheral edge of the annular top surface portion by a linking piece, and the annular top surface portion and the skirt having a pair of breaking weakened lines extending from both side edges of the linking piece. A set of lance slits is formed in a metal blank, and a pair of weakening lines is formed spaced from each other at a predetermined distance in the circumferential direction and extending over a predetermined distance from near the lance slits toward the center of a circular portion located inwardly of the lance slits. An opening is punched out of the circular portion and the circular portion located inwardly of the lance slits is drawn to form a shell having a circular top with said opening therein and a substantially cylindrical skirt continuous therewith. A slit is formed along said opening spaced a predetermined distance outwardly from the opening. The portion between the opening and the slit is then bent to form a pull ring, and the thus formed shell is separated from the metal blank.

5 Claims, 26 Drawing Figures

8834-IE-SE (RR)

Fig. 23-A
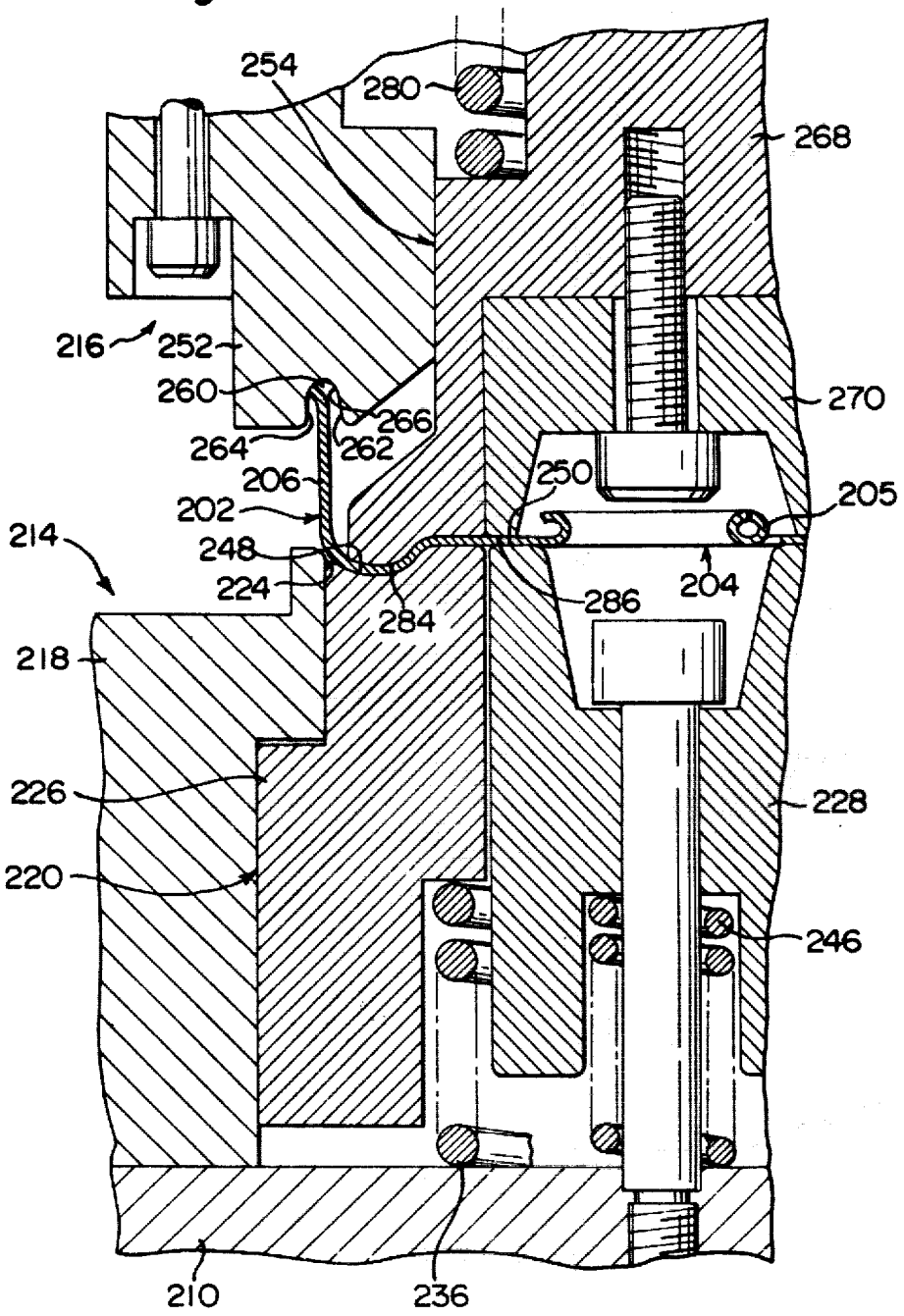

Fig. 23-B
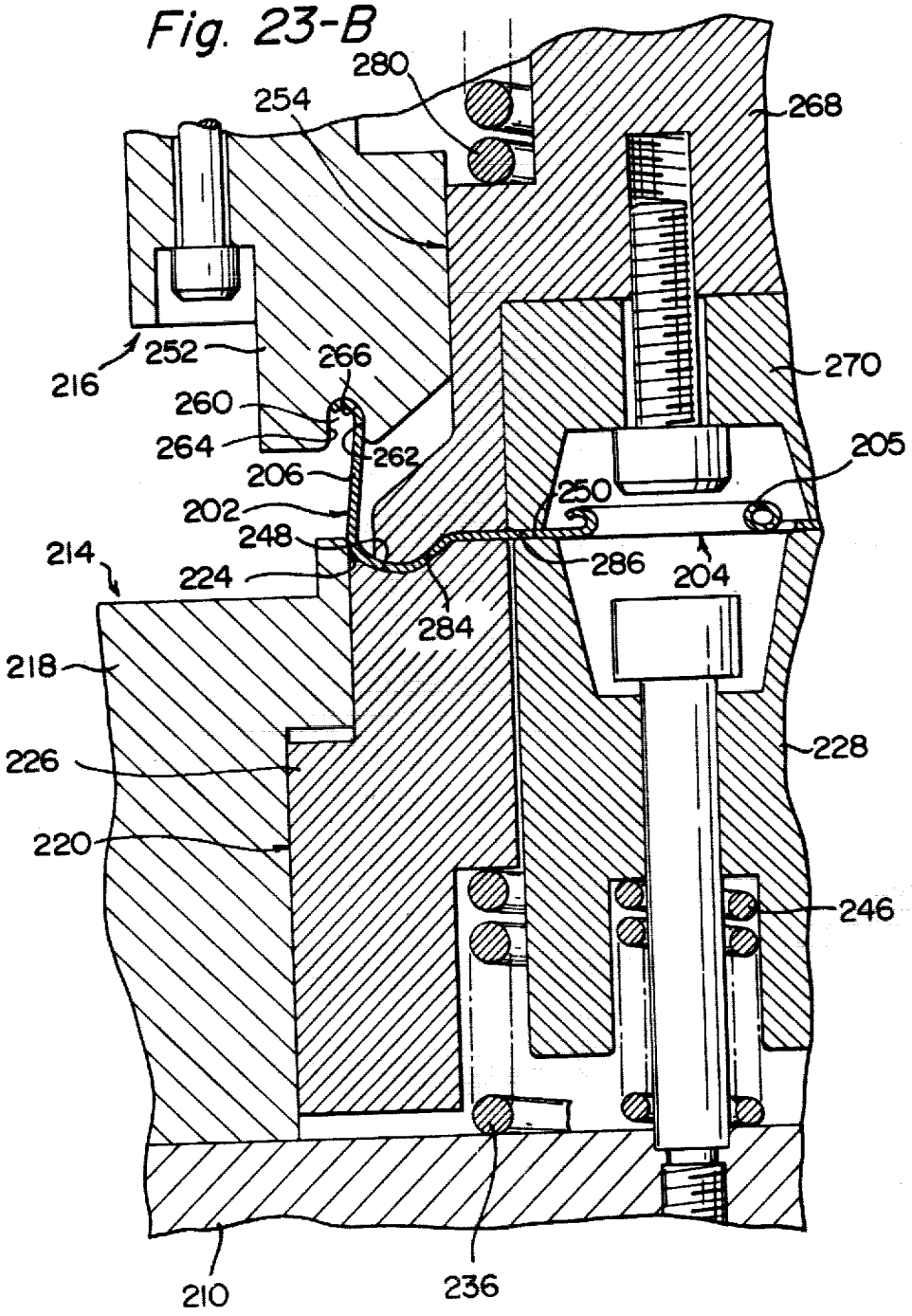

Fig. 23-C
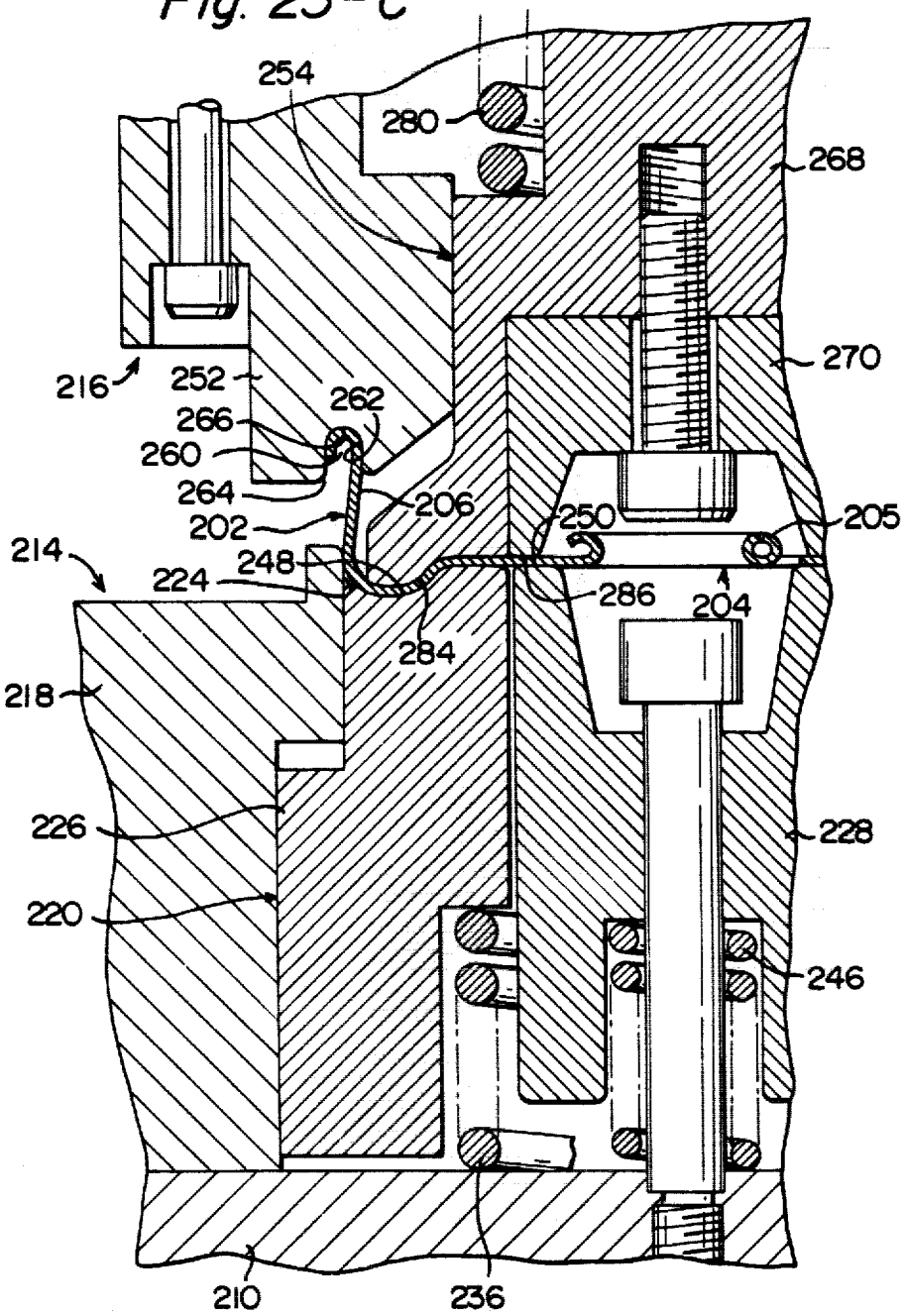

Fig. 23-D
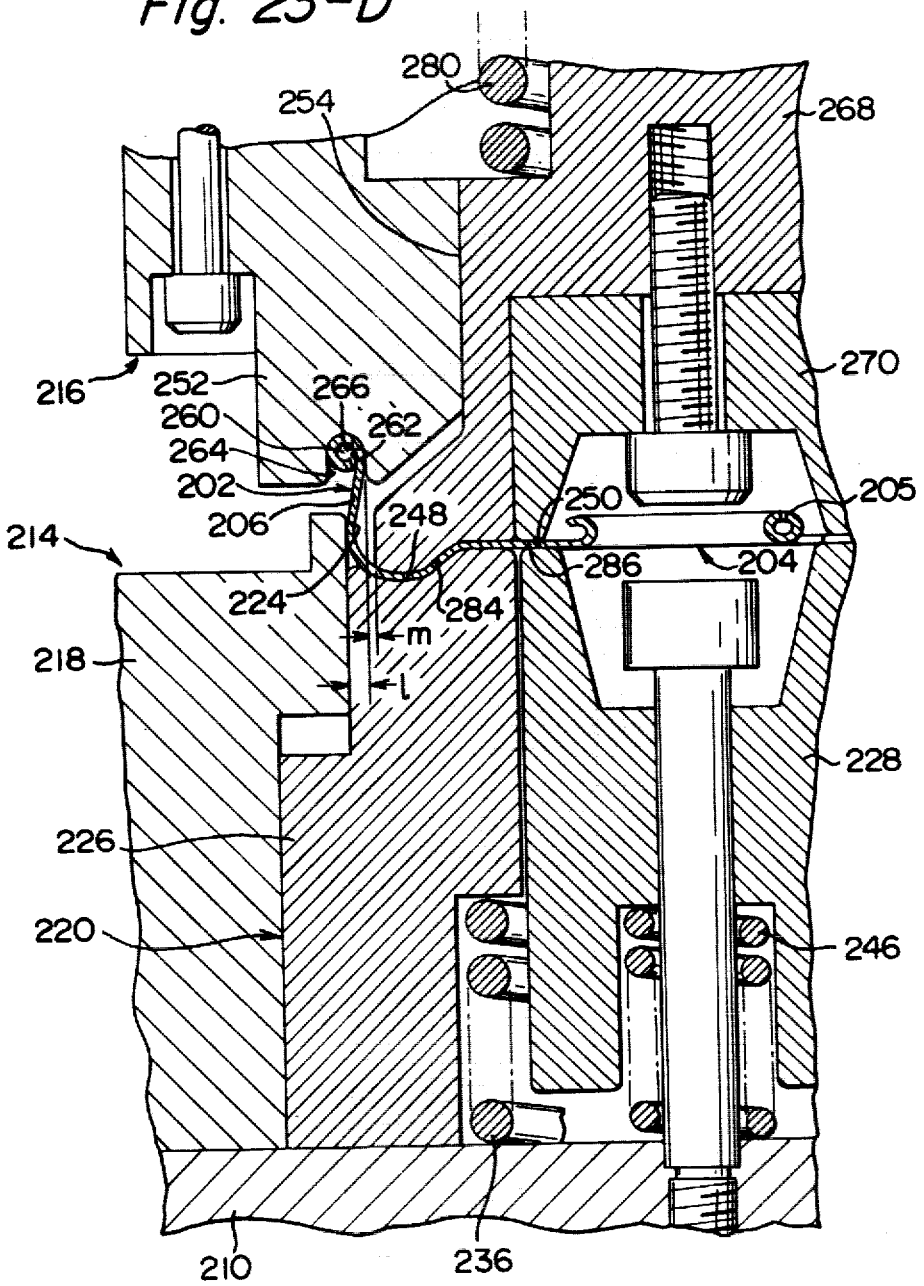

METHOD OF PRODUCING AN EASILY OPENABLE CONTAINER CLOSURE HAVING A SHELL AND A SEALING MEMBER

This is a division of application Ser. No. 16,606, filed Mar. 1, 1979, now U.S. Pat. No. 4,197,956.

BACKGROUND OF THE INVENTION

1. Field of the Invention

This invention relates to a method of producing an easily openable container closure having a shell and sealing member. More specifically, this invention relates to a method of producing an easily openable container closure comprising (1) a shell of a unitary structure including a top and a cylindrical skirt, said top having an annular top surface portion leading to the upper end of the skirt and a pull ring connected to a part of the inner peripheral edge of the annular top surface portion through a linking piece, and the annular top surface portion and the skirt having a pair of breaking weakened lines formed along the phantom lines extending from both side edges of the linking piece, and (2) a sealing member positioned within the shell for closing an opening present in the top surface of the shell.

2. Description of the Prior Art

French Pat. No. 2,231,578 and U.S. Pat. No. 3,596,790 disclose an easily openable container closure of the above-mentioned structure for use in closing the mouth of a container such as a bottle or can. Because such a container closure can be easily opened without using such an instrument as an opener, and can be produced at a lower cost than the other types of easily openable container closures disclosed, for example, in Japanese Patent Publication No. 26107/76 and Japanese Laid-Open Patent Publication No. 29073/72, its use has been strongly desired recently in place of ordinary crown caps or the easily openable container closures of the types disclosed in the above Japanese Patent documents.

The known easily openable container closures disclosed in the French and American Patents pose various problems because, for example, the pull ring provided in the shell tends to project upward beyond the upper end of the skirt of the shell and the upper surface of the annular top surface portion.

In the container closure disclosed in French Pat. No. 2,231,578, the annular top surface portion of the shell extends inwardly and substantially horizontally from the upper end of the skirt, and from the inner peripheral edge of the annular top surface portion, the linking piece and the pull ring extend inwardly and substantially horizontally, whereby the upper end of the skirt, the annular top surface portion, the linking piece and the pull ring are positioned substantially on the same plane. However, because an inwardly directed force is exerted on the lower end portion of the skirt at the time of mounting a container closure on the mouth of a bottle or the like, the annular top surface portion and the linking piece are inclined upwardly in the inward direction, and as a result, the pull ring tends to projects upwardly beyond the annular top surface portion. Pull rings having such a tendency collide with various objects during the transportation of bottles provided with closures or during the transfer of such bottles in automatic vendor machines. This results in undue forces on the pull rings, and the shells may be accidentally broken along a pair of weakened lines. Or the transfer of bottles in automatic vending machines is obstructed, and the operation of the automatic vendors becomes temporarily out of order.

In the container closure disclosed in U.S. Pat. No. 3,596,790, in an attempt to solve the problems associated with the container closure disclosed in the above-cited French Patent, the linking piece connecting the annular top surface portion and the pull ring of the shell to each other is caused to extend downwardly in an inclined manner, instead of inwardly and substantially horizontally, from a part of the inner peripheral edge of the annular top surface portion, whereby the pull ring extending inwardly from the inside end of the linking piece is located at a lower position than the annular top surface portion. In a container closure of such a construction, too, the annular top surface portion is formed only of a portion extending substantially horizontally, and therefore, the rigidity of the annular top surface portion is not sufficient. When a force is exerted on the lower end portion of the skirt of the shell to deform it inwardly at the time of mounting the container closure around the mouth of a container such as a bottle, the annular top surface portion and the linking piece are displaced inclinedly upwardly in the inward direction and in the direction of the inside diameter. Owing to this, the pull ring is displaced upwardly, and a part of it tends to be located at a higher position than the annular top surface portion. Furthermore, since the annular top surface portion does not have sufficient rigidity, it is likely that when the container closure is mounted on the mouth of a container, the annular top surface portion will be deformed, or a pair of breaking weakened lines formed in the annular top surface portion will be broken at an early stage. Moreover, even after mounting, the annular top surface portion may be deformed easily upon the application of impact, resulting in the reduced ability to seal the container.

SUMMARY OF THE INVENTION

It is a primary object of this invention to provide a method of making a novel and excellent easily openable container closure of the aforesaid structure in which the pull ring does not project upwardly beyond the upper end of the skirt and the uppermost surface of the annular top surface portion, and therefore, the aforesaid problems do not arise.

As a result of extensive investigations and experimental work, the present inventor has now found that when the annular top surface portion of the shell is made at least of a first annular portion extending inwardly from the upper end of the skirt and a second annular portion extending downwardly and inwardly in an inclined manner from the first annular portion, the pull ring can be positioned at a lower level than the uppermost surface of the annular top surface portion by the presence of the second annular portion, and the rigidity of the annular top surface portion is considerably increased by the presence of at least the first and second annular portions, whereby the aforesaid problems with the container closure disclosed in U.S. Pat. No. 3,596,790 are overcome.

The easily openable container closure made by the method of this invention has (1) a shell of a unitary structure comprising a top and a cylindrical skirt, said top having an annular top surface portion leading to the upper end of the skirt and a pull ring leading to a part of the inner peripheral edge of the annular top surface portion through a linking piece, and said annular top surface portion and skirt having a pair of breaking weakened lines formed along the phantom lines extending from both sides of said linking piece, and (2) a sealing member positioned within said shell and closing an opening present in the top surface of said shell; said annular top surface portion of the shell at least having a first annular portion extending inwardly from the upper end of the skirt and a second annular portion extending downwardly and inwardly in an inclined manner from the first annular portion, and said linking piece extending inwardly from a part of the inner peripheral edge of the annular top surface portion and the pull ring extending inwardly from the inside end of the linking piece being located at a lower level than the uppermost surface of the annular top surface portion.

In relation to this object, the present invention provides a method for producing a shell of a unitary structure comprising a top and a cylindrical skirt, said top having an annular top surface portion leading to the upper end of the skirt and a pull ring leading to a part of the inner peripheral edge of the annular top surface portion through a linking piece, said annular top surface portion and skirt having a pair of breaking weakened lines formed along the phantom lines extending from both side edges of said linking piece, the method comprising (a) forming at least one set of lance slits in a flat metal blank, said lance slits having at least two discontinuous portions located at a predetermined distance in the circumferential direction (the lance slit-forming step), (b) forming a pair of breaking weakened lines at a predetermined distance in the circumferential direction, said breaking weakened lines extending over a predetermined distance from near the lance slits toward the center of a circular portion located inwardly of the lance slits (the breaking line-forming step), (c) punching out an opening of a predetermined dimension in the circular portion located inwardly of the lance slits (the punching step), (d) at least after the lance slit-forming step (a) and the breaking line-forming step (b), drawing the circular portion located inwardly of the lance slits to form a shell having a circular top with said opening and a substantially cylindrical skirt continuous thereto (the drawing step), (e) at least after the drawing step (d), forming a slit along said opening from near the inside end of one of said breaking weakened lines to the vicinity of the inside end of the other breaking line on the top, said slit being spaced a predetermined distance from said opening outwardly in the radial direction (the slit-forming step), (f) after the punching step (c) and the slit-forming step (e), bending the portion between said opening of the top and the slit to form a pull ring (the bending step), and (g) after the bending step (f), separating the formed shell from the metal blank (the shell-separating step).

BRIEF DESCRIPTION OF THE DRAWINGS

FIGS. 23A to 23D are partial enlarged sectional views for illustrating the operation and result of the press-forming device shown in FIG. 22.

DETAILED DESCRIPTION OF PREFERRED EMBODIMENTS

The invention will be described in greater detail below with reference to the accompanying drawings which show preferred embodiments of this invention.

Figure 1:
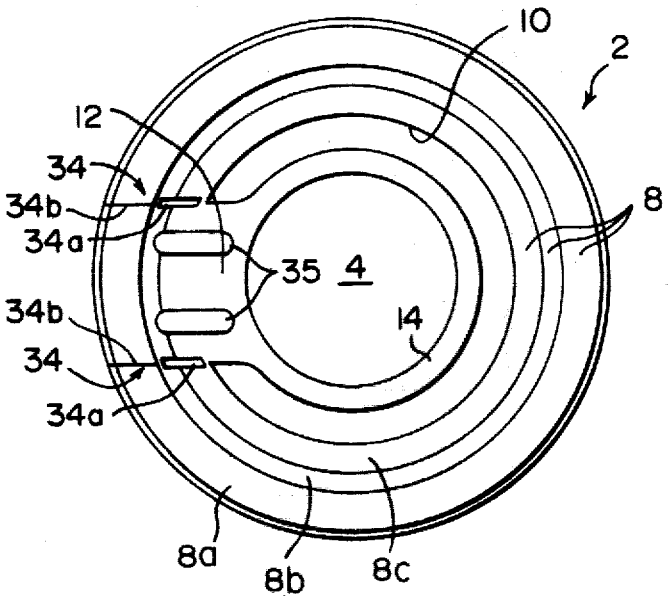
FIG. 1 is a top plan of a first embodiment of the container closure in accordance with this invention.
Figure 2:
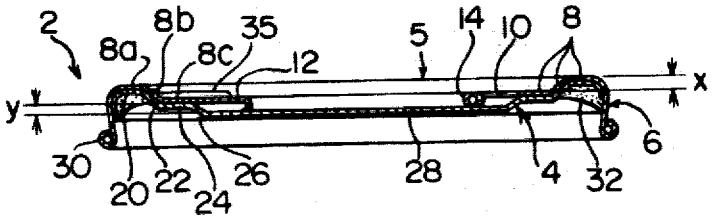
FIG. 2 is a sectional view of the container closure shown in FIG. 1.

Referring to FIGS. 1 and 2 which show a first embodiment of a simple openable container closure in accordance with this invention, the container closure includes a shell 2 and a sealing member 4. The shell 2 is made of a unitary structure of a metal blank such as aluminum, tin plate or chrome steel plate, and is composed of a generally circular top 5 and a substantially cylindrical skirt 6. The top 5 has an annular top surface 8 leading to the upper end of the skirt 6 and a pull ring 14 leading to the annular top portion 8 through a linking piece 12 extending inwardly from a part of the inner peripheral edge 10 of the annular top surface 8.

In the embodiments illustrated in FIGS. 1 and 2, the annular top surface 8 of the shell 2 includes a first annular portion 8*a* extending inwardly from the upper end of the skirt 6, a second annular portion 8*b* extending downwardly and inwardly in an inclined manner from the first annular portion 8*a*, and a third annular portion 8*c* extending inwardly and substantially horizontally from the second annular portion. As can be appreciated clearly from FIG. 2, therefore, the inner peripheral edge 10 of the annular top surface 8 is located at a lower position than the uppermost surface of the first annular portion 8*a* by the being x caused by the inclination of the second annular portion 8*b*.

The linking piece 12 extending inwardly from a part of the inner peripheral edge 10 of the annular top surface 8 and the pull ring 14 extending inwardly from the inside end of the linking piece 12 may extend substantially horizontally, or be inclined somewhat downwardly or upwardly toward the inside. However, it is important that they should be located at a position lower than the uppermost surface of the annular top surface 8. In the embodiment illustrated in FIGS. 1 and 2, the linking piece 12 extends substantially horizontally toward the inside from a part of the inner peripheral edge of the third annular portion 8*c*. The pull ring 14, which is preferably subjected to a bending operation to render its sectional surface roughly circular as disclosed in the above-cited French Pat. No. 2,231,578 and U.S. Pat. No. 3,596,790, extends substantially horizontally from the inside end of the linking piece 12. Hence, the linking piece 12 and the pull ring 14 are located at substantially the same height as the top surface of the third annular portion 8*c* of the annular top portion 8, and at a position lower than the uppermost surface of the annular top portion 8 by the level x.

In the shell 2 described above, the annular top portion 8 includes the first to third annular portions 8*a* to 8*c*, and a bended or curved portion is formed in the interface between the first annular portion 8*a* and the second annular portion 8*b*, and in the interface between the second annular portion 8*b* and the third annular portion 8*c*. Accordingly, the annular top portion 8 has fairly high rigidity, and when a force directed inwardly is applied to the lower end portion of the skirt 6 at the time of stopping the mouth of a container such as a bottle, the annular top portion 8 and the linking piece 12 are not inclined upwardly toward the inside. As a result, the pull ring 14 is not displaced upwardly from the position indicated in the drawing. Even if the annular top portion 8 and the linking piece 12 are inclined inwardly toward the inside, the amount of inclination is so slight that the pull ring 14 never goes beyond the level difference x and never projects upwardly beyond the uppermost surface of the top portion 8.

In the embodiment shown in the drawing, the third annular portion 8*c* is provided which extends substantially horizontally toward the inside from the second annular portion 8*b* of the annular top portion 8, and the linking piece 12 is caused to extend inwardly from part of the inner peripheral edge of the third annular portion 8*c*. It is possible also to omit the third annular portion 8*c*, and cause the linking piece 12 to extend directly from a part of the inner peripheral edge of the second annular portion 8*b*. When the third annular portion 8*c* is omitted, the bended or curved portion exists only in the boundary between the first and second annular portions 8*a* and 8*b*, and therefore, the rigidity of the annular top portion 8 is reduced somewhat over the embodiment shown in the drawings.

The sealing member 4 preferably made of a metal blank such as aluminum, tin plate or chrome steel plate, as shown clearly in FIG. 2, closes the openings positioned within the shell 2 and present on the top surface of the shell 2 (i.e., the circular opening inwardly of the pull ring 14, and the arcuate opening between the pull ring 14 and the inner peripheral edge of the annular top portion 8). The sealing member 4 may be of any suitable shape corresponding to the shape of the shell 2. Preferably, it is a generally circular material having a periphery 20 to be contacted with the upper end of the skirt 6 of the shell and with the inner surface of the first annular portion 8*a* of the annular top portion 8; a first inclined portion 22 extending from the periphery 20 downwardly or inwardly in an inclined manner and contacting the inside surface of the second annular portion 8*b* of the annular top portion 8 of the shell 2; an outside flat portion 24 extending inwardly and substantially horizontally from the inclined portion 22 and contacting the third annular portion 8*c* of the annular top portion 8 of the shell 2; a second inclined portion 26 extending downwardly and inwardly from the outside flat portion 24; and a central flat portion 28 extending from the second inclined portion 26. The second inclined portion 26 of the sealing member 4 provides a level difference y, which is substantially equal to, or slightly larger than, the thickness of the pull ring 14 in the perpendicular direction, between the outside flat portion 24 and the central flat portion 28. In the embodiment shown in the drawings, the level difference y is substantially equal to the thickness of the pull ring 14 in its perpendicular direction, but by increasing the level difference y somewhat larger than it, some space can be provided between the lower surface of the pull ring 14 and the central flat portion 28 of the sealing member which makes it easy to lift the pull ring 14 by a finger tip. The second inclined portion 26 of the sealing member 4 serves to form a bended or curved portion in the boundary between it and the outside flat portion 24 and in the boundary between it and the central flat portion 28, and thus increases the buckling strength of the sealing member 4. Preferably, the inner peripheral edge of the outside flat portion 24 of the sealing member 4 is constructed such that it substantially registers with the inner peripheral edge 10 of the annular top portion 8 of the shell 2 so as not to form a space between the top surface of the sealing member 4 and the lower surface of the annular top portion 8 of the shell 2. When the inner peripheral edge 10 of the annular top portion 0 extends inwardly beyond the inner peripheral edge of the outside flat portion 24, a space will be formed between the bottom surface of the annular top portion 8 and the top surface of the outside flat portion 24 in which dust, water, etc. tend to gather.

As illustrated clearly in FIG. 2, the skirt 6 of the shell 2 is preferably inclined somewhat inwardly from its upper end portion to its lower end portion so that its inside diameter is somewhat smaller at the lower end than at the upper end. A curl portion 30 known per se may be formed at the lower end of the skirt 6. Preferably, the outside diameter of the sealing member 4 is substantially equal to, or somewhat smaller than, the inside diameter or the skirt 6 at the upper end, but is somewhat larger than the inside diameter of the skirt at the lower end. The sealing member 4 described hereinabove is inserted into a predetermined position as shown in FIG. 2 by pushing the lower end portion of the skirt 6 of the shell 2 into the shell 2 while somewhat elastically deforming it. Once the sealing member 4 has been inserted into the predetermined position, it is kept from removal because the inside diameter of the skirt 6 at the lower end is somewhat smaller than the outside diameter of the sealing member 4.

An annular gasket layer 32 for sealing the opening portion of a container upon engagement with the top portion of the opening of the container (see FIG. 8) may be provided on the inner outer periphery of the sealing member 4 inserted into the predetermined position of the shell 2. This annular gasket layer 32 may be provided only at the inner outer peripheral edge of the sealing member 4 alone. However, as shown in FIG. 2, it is preferably provided in a manner to cover both the outer peripheral edge of the inside surface of the sealing member 4 and the inside surface of the skirt 6 of the shell 2 so that the sealing member 4 and the shell 2 are bonded by the annular gasket layer 32. This enables the shell 2 and the sealing member 4 to be maintained integral even after the shell 2 has been broken along a pair of breaking weakened lines as will be described hereinbelow. Thus, the opening of the container can be temporarily closed by repeatedly utilizing the opened container closure. Furthermore, as a result of this construction, when the shell 2 is broken along a pair of breaking weakened lines, and a force is exerted on the shell 2 by a finger tip to remove it from the opening of the container, the sealing member 4 can be exactly removed together with the shell. Hence, the closure opening operation can be effected easily and exactly.

It is important that as shown in FIG. 1, a pair of breaking weakened lines 34 should be formed in the annular top portion 34 and the skirt 6 along the phantom lines extending from both side edges of the linking piece 12. Each of the weakened lines may be of any desired form, such as a score resulting from incision of a metal blank partly toward its thickness, or a stitch-like perforation resulting from intermittent incision of a metal blank. In the embodiments shown in FIGS. 1 and 2, each of the weakened lines consists of a slit 34*a* which extends continuously from a position spaced a little from the inside edge 10 outwardly in the radial direction to the neighborhood of the outside edge of the second annular portion 8*b* of the annular top portion 8, and a score 34*b* which extends from a position spaced a little from the outside end of the slit 34*a* outwardly in the radial direction (i.e. from the inside end of the first annular portion 8*a* of the annular top portion 8 (to the lower end of the skirt 6.

As will be described in detail hereinbelow, the shell 2 is generally produced by drawing a metal blank. In the drawing operation, the second and third annular portions 8*b* and 8*c*, especially the boundary zone between them, drastically undergo plastic deformation, and are hardened in this state. Accordingly, when the weakened lines are to be broken by pulling the pull ring 14, breaking of the weakened lines is sometimes difficult in the areas of the second and third annular portions 8*b* and 8*c*. However, in the specific embodiment shown in FIGS. 1 and 2, the weakened lines 34 consist of continuously extending slits 34*a* in the areas of the second and third annular portions 8*b* and 8*c*. Accordingly, the breaking of the weakened lines in these areas can be performed exactly and easily.

In the embodiments shown in FIGS. 1 and 2, a pair of reinforcing projections 35 known per se which extend parallel to the breaking lines 34 are formed between the breaking weakened lines 34. These reinforcing projections 35 ensure exact breaking of the weakened lines 34 which sometimes becomes difficult or impossible because of the bending of the metal blank at the linking piece 12 or the neighboring portion.

Figure 3:
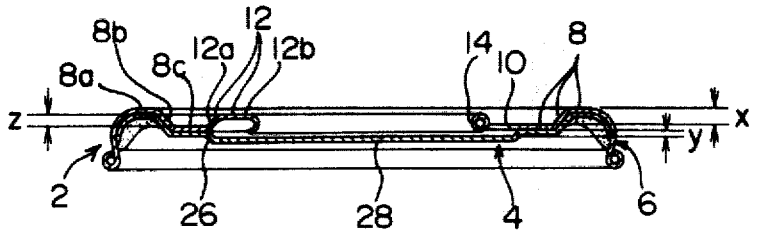
FIG. 3 is a sectional view of a second embodiment of the container closure in accordance with this invention.
Figure 4:
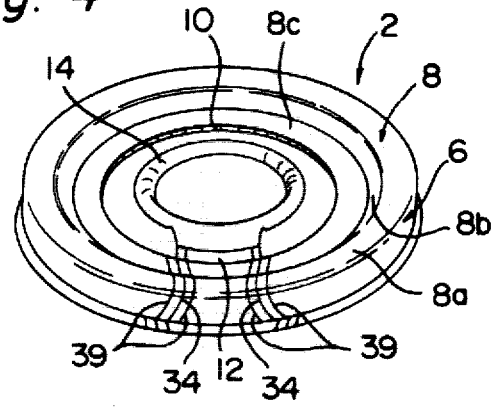
FIG. 4 is a perspective view of the shell of the container closure shown in FIG. 3.

FIGS. 3 and 4 show a second embodiment of the easily openable container closure in accordance with this invention. The second embodiment results from some modification of the first embodiment. In the second embodiment, the linking piece 12 of the shell 2 includes a first portion 12*a* extending upwardly and inwardly in an inclined manner from the inner peripheral edge 10 of the annular top portion 8, and a second portion 12*b* extending inwardly and substantially horizontally from the portion 12*a*. Hence, the top surface of the second portion 12*b* of the linking piece 12 is at a higher position than the inside edge 10 of the annular top portion 8 by the level difference z caused by the inclination of the first portion 12*a*. It is important that the level difference z should be nearly equal to the thickness of the pull ring 14 in the perpendicular direction, and smaller than the level difference x mentioned above, and therefore, that the top surface of the second portion 12*b* of the linking piece 12 should be at a lower position than the uppermost surface of the first annular portion 8*a* of the annular portion 8. The pull ring 14 extends substantially horizontally from the second portion 12*b* of the linking piece 12. Hence, the top surface of the pull ring 14 is substantially at the same height as the top surface of the second portion 12*b* of the linking piece 12, and therefore, is at a lower position than the uppermost surface of the annular top portion 8. In the shell 2 described above, a bended or curved portion is formed in the boundary between the inner peripheral edge 10 of the annular top portion 8 and the portion 12*a* of the linking piece 12 and also at the boundary between the first portion 12*a* and the second portion 12*b*, thus increasing the rigidity of the linking piece 12. Accordingly, even when an inwardly directed force is exerted on the lower end portion of the skirt at the time of closing the opening of a container such as a bottle, upward projection of the pull ring 14 beyond the position shown in the drawings can be prevented more exactly.

In the embodiment shown in FIGS. 3 and 4 in which the linking piece 12 has the first and second portions 12*a* and 12*b*, a space is formed between the bottom surface of the pull ring 14 of the shell 2 and the central flat portion 28 of the sealing member 2 correspondingly to the level difference y caused by the second inclined portion 26 of the sealing member. Thus, it is easy to lift the pull ring 14 by a finger tip at the time of breaking.

Figure 5:
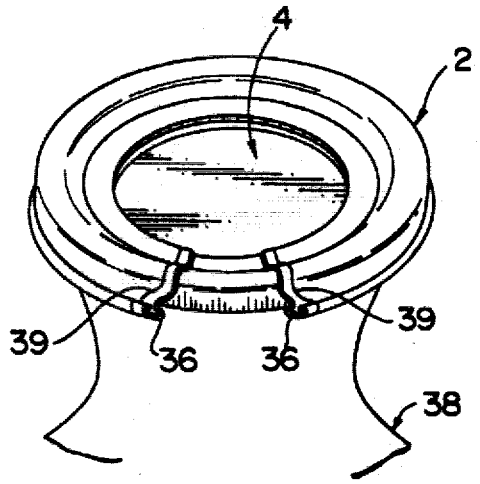
FIG. 5 is a perspective view of the second embodiment of the container closure of this invention which is located on the mouth of a container after its shell has been broken off.

Furthermore, in the embodiment shown in FIGS. 3 and 4, the breaking lines 34 are composed of a pair of scores, as shown in FIG. 4, which extend from the inner peripheral edge 10 of the annular top surface 8 to the first annular portion 8*a* of the annular portion 8 so that the space between them decreases gradually, and from the top end of the skirt 6 to the lower end of the skirt 6 so that the distance between them gradually increases. As described hereinabove, when the shell 2 is produced by drawing, the annular top portion 8 is hardened. However, when the breaking weakened lines 34 are composed of a pair of scores in the form described above, the distance between the weakened lines 34 decreases gradually in the area extending from the inner peripheral edge 10 of the annular top portion 8 to the first annular portion 8*a* of the annular portion 8. Accordingly, the force is transmitted effectively from the pull ring 14 to the breaking portion (i.e., the weakened lines 34), and breaking can be effected with relative ease in the above region, too. Furthermore, since the breaking weakened lines 34 extend from the upper end to the lower end of the skirt 6 so that the distance between them increases gradually, a break end 36 at the lower end of the skirt 6 is of a relatively obtuse angle after breaking the shell 2 as can be easily appreciated from FIG. 5. Hence the break end 36 does not injure fingers when the closure is to be removed from the container 38 by pulling out the lower end of the skirt 6 of the shell 2 by fingers after the breaking of the scores.

Figure 6:
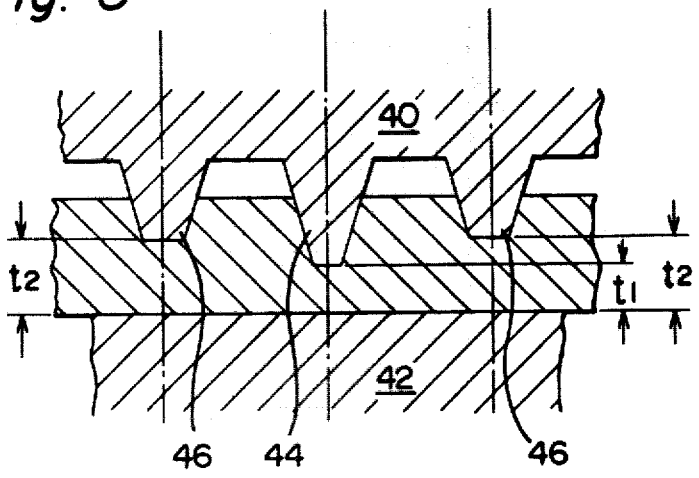
FIG. 6 is an enlarged sectional view, in part, of a score and an auxiliary score formed in the shell shown in FIG. 4, and a punch and a die for providing these scores.

When as in the embodiment shown in FIGS. 3 and 4, each of the weakened lines is a score formed by incising a metall blank in the direction of its thickness, it is preferred to provide auxiliary scores 39 formed by reducing the thickness of the blank to thickness $t_2$ which is somewhat larger than the thickness $t_1$ of the blank having the score formed therein, as illustrated in FIG. 6. In such an embodiment, scores 34 may be formed by using a score punch 40 and a score die 42 as illustrated in FIG. 6. Generally, the tendency of the metal blank to be curved or inclined at a score-forming projection 44 of the score punch is inhibited by the action of auxiliary score-forming projections 46 on the metal blank on both sides of the score-forming projection 44. Thus, the scores can be formed accurately in the desired shape. Furthermore, even if breaking accidentally deviates from the weakened lines, such deviation stops at the auxiliary scores 39, and the subsequent breaking can be performed along the auxiliary scores 39. Hence, the breaking of the shell 2 never fails.

The third embodiment illustrated in FIG. 7 results from the modification of the sealing member 4 in the following manner. In the third embodiment, the outside flat portion and the second inclined portion are omitted in the sealing member 4, and the central flat portion 28 directly follows the first inclined portion 22. If some space for easy lifting of the pull ring 14 by a finger tip is formed between the undersurface of the pull ring 14 and the central flat portion 28 of the sealing member 4 by somewhat increasing the level difference by the first inclined portion 22, a space where dust, water, etc. tend to gather will be formed between the lower surface of the third annular portion 8*c* of the annular top portion 8 and the central flat portion 28. It is desirable therefore to close the above space by curving the free edge portion of the annular top portion 8 to which the linking piece is not connected.

Figure 8:
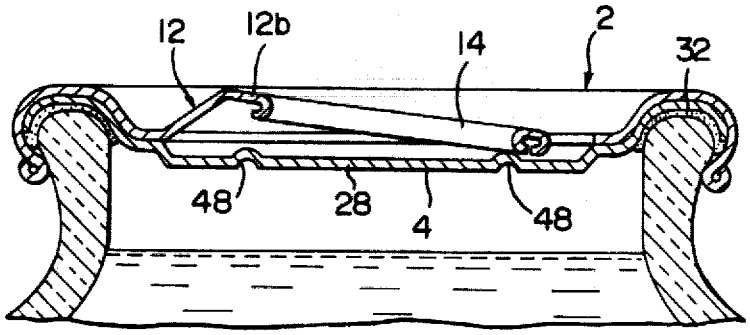
FIG. 8 is a sectional view of a fourth embodiment of the container closure in accordance with this invention as it closes the mouth of a container.
Figure 9:
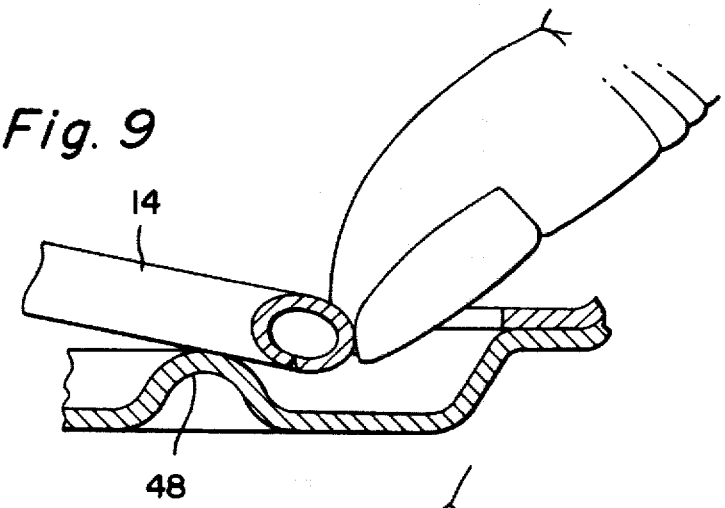
FIG. 9 is an enlarged sectional view, in part, of the container closure shown in FIG. 8.
Figure 10:
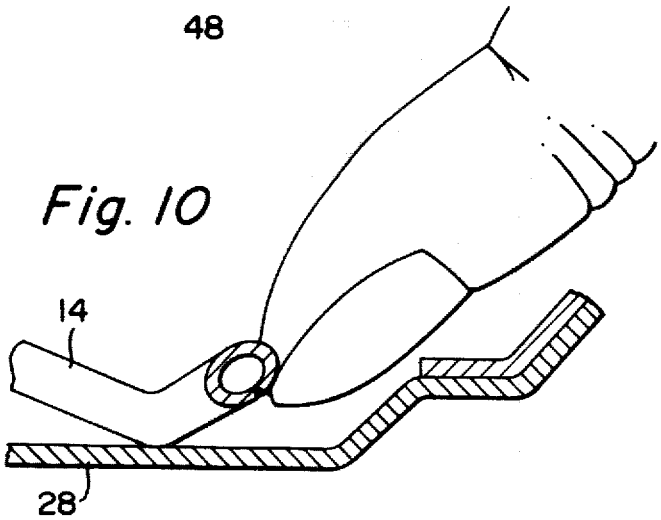
FIG. 10 is an enlarged sectional view, in part, of a fifth embodiment of the container closure in accordance with this invention.

In the fourth embodiment shown in FIGS. 8 and 9, the second portion 12*b* of the linking piece 12 of an outside closure 2 and the pull ring 14 are caused to extend inwardly in a somewhat downwardly inclined state instead of extending inwardly and substantially horizontally toward the inside. In such a case, it is possible to provide projections 48 at those positions of the central flat portion 28 which correspond to the neighborhood of the free end of the pull ring 14 so as to form some space between the undersurface of the free end of the pull ring 14 and the top surface of the central flat portion 28 which makes it easy to lift the pull ring 14 by a finger tip, as clearly illustrated in FIG. 9. Alternatively, a a space may be formed between the undersurface of the pull ring 14 and the central flat portion 28 of the sealing member 4 by curving the free end of the pull spring 14 somewhat upwardly as illustrated in FIG. 10.

In each of the embodiments shown hereinabove, the pull ring 14 is provided substantially centrally in the shell 2. It will be clear that when the shell 2 is of a large diameter, the pull ring 14 may, if desired, be located at a position eccentric with respect to the center of the shell 2.

Now, a manufacturing method which can be suitably applied to the production of the shell of the easily openable container closure in accordance with this invention will be described.

The shell of the easily openable container closure described in detail hereinabove with reference to FIGS. 1 to 10, and the shell of the easily openable container closure disclosed in the above-cited French Pat. No. 2,231,578 and U.S. Pat. No. 3,596,790, commonly consists of a top and a cylindrical skirt, said top including an annular top surface portion connected to the upper end of the skirt and a pull ring connected to a part of the inner peripheral edge of the annular top surface portion through a linking piece, and said annular top surface portion and said skirt having a pair of breaking weakened lines formed along the phantom lines extending from both side edges of said linking piece. In the production of such a shell, it has been the previous practice to process a top plate-like metal blank by punching and bending to form the pull ring, a circular opening located inwardly of it, and an arcuate opening located outwardly of it, then forming a pair of breaking weakened lines, and drawing the metal blank to form a shell having a top including the pull ring and a cylindrical skirt. It has been found however that in such a method, cracks occur near both end portions of the arcuate opening outwardly of the pull ring, or breakage occurs along the breaking lines, during the drawing operation to make the resulting shell useless, or that the arcuate opening outwardly of the pull ring is considerably distorted and the appearance of the outside shell is heavily damaged.

The present inventor has now found that the aforesaid problems can be solved satisfactorily by drawing the metal blank prior to the slit-forming step and the bending step for the formation of the pull ring, so that a shell having a circular top and a cylindrical skirt of a predetermined depth may be formed in advance.

One embodiment of the method of this invention is described below in detail with reference to FIGS. 11 to 18.

Figure 11:
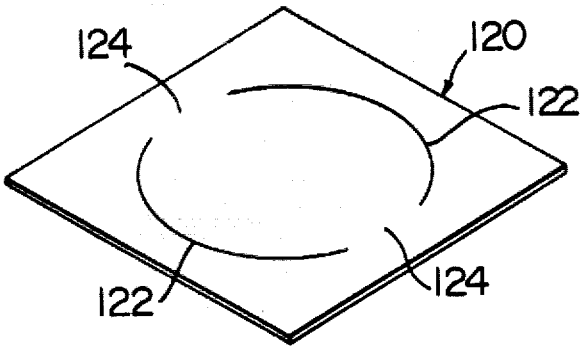
FIGS. 11 to 18 are perspective views showing the individual steps of one embodiment of the method for producing a shell in accordance with this invention.

First, a set of inside circular lance slits 122 known per se are formed in a rectangular metal blank 120 (FIG. 11). The inside circular lance slits 122 have at least two (two in the drawing) discontinuous portions 124 located at predetermined intervals in the circumferential direction.

Figure 12:
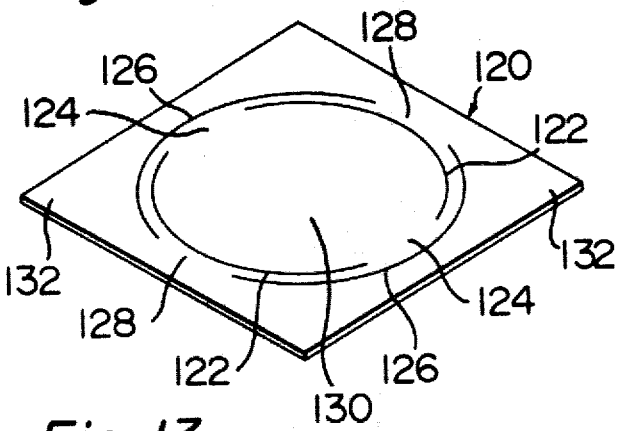

Then, a set of outside circular lance slits 126 having a somewhat larger diameter than the diameter of the inside circular lance slits 122 are formed concentrically with the inside circular lance slits 122 (FIG. 12). The outside circular lance slits 126 have at least two (two in the drawing) discontinuous portions 128 positioned at predetermined intervals in the circumferential direction. Each of the discontinuous portions 128 is positioned midway between the two discontinuous portions 124 when viewed in the circumferential direction. Accordingly, in FIG. 12, the discontinuous portions 124 and the discontinuous portions 128 are disposed alternately at an interval of 90°.

Provision of the lance slits 122 and 126 are necessary to prevent deformation of the peripheral portion 132 of the metal blank 120 during the formation of a circular portion 130 inwardly of the inside circular lance slits 122 by drawing, and to perform the drawing of the metal blank 120 accurately. Generally, when the manufacturing process is to be performed automatically and continuously, feeding and positioning of the metal blank 120 are effected by utilizing the peripheral edge 132 of the metal blank 120 by one or more guide holes formed there. Therefore, if the peripheral edge 132 of the metal blank 120 is deformed, it is impossible to accurately feed and position the metal blank 120.

In the drawings, two sets of the inside and outside lance slits 122 and 126 are formed. When the depth of drawing of the circular portion 130 of the metal blank 120 is relatively shallow, the desired object may be achieved by providing only one set of circular lance slits. When the depth of drawing is relatively large, concentrically aligned three or more sets of circular lance slits may be formed as required. Further, in the drawing operation, the lance slits in each set from a generally circular shape, but they may be of another shape such as a convoluted shape known to those skilled in the art.

Figure 13:
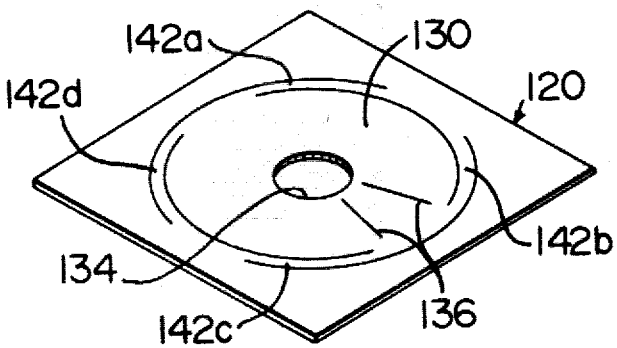

Subsequent to the lance slit-forming step (FIGS. 11 and 12), a circular opening 134 is punched out at the center of the circular portion 130 of the metal blank 120 (punching step), and a pair of breaking weakened lines 136 are formed (breaking line-forming step) (see FIG. 13). The circular opening 134 will be located inwardly of the pull ring to be formed later, and a pair of the breaking lines 136 are for the purpose of breaking the shell. The breaking lines 136 are spaced in the circumferential direction and extend from the neighborhood of the inside circular lance slits 122 toward the center of the circular portion 130. They may be so-called scores obtained by incising the metal blank 120 partly in its thickness direction, stitch-like perforations resulting from intermittent incising of the metal blank 120, or a combination of slits and scores illustrated in FIG. 1. In the embodiment illustrated in the drawings, the breaking lines 136 are straight lines, but the form of the breaking lines is not limited thereto, and may be of other forms such as curves shown in FIG. 4.

Figure 14:
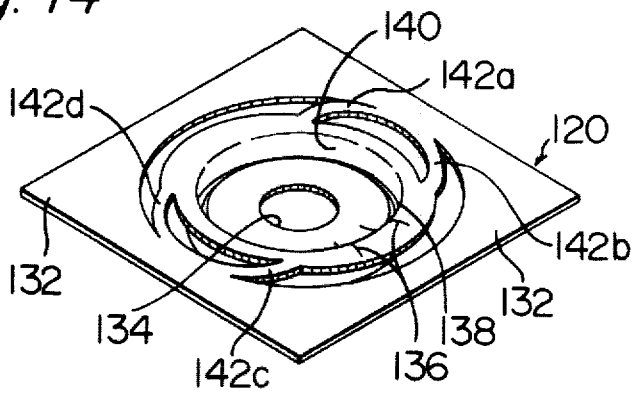

Subsequent to the punching step and the breaking line-forming step (FIG. 13), the circular portion 130 of the metal blank 120 is drawn to form a shell having a circular top 138 and a cylindrical skirt 140 of a predetermined depth (drawing step; FIG. 14). In the drawing operation, the circular portion 130 of the metal blank 120 is formed into the shell of the aforesaid structure, and by the effect of the drawing, annular portions 142*a*, 142*b*, 142*c* and 142*d* are considerably deformed, as is readily appreciated from FIGS. 13 and 14. However, since these annular portions 142*a* to 142*d* are easily deformed, the deformation of the peripheral edge 132 of the metal blank 120 by the effect of the drawing is substantially prevented, and the accurate drawing of the metal blank to form the desired shell can be ensured.

In the drawing operation, the annular peripheral edge of the top 138 of the shell (such an annular peripheral edge will become an annular top portion of the completed shell) can be formed in a shape corresponding to the shape of the annular top portion 8 of the shell 2 illustrated, for example in FIGS. 1 and 2 by using a drawing punch and a drawing die having a suitable configuration.

Figure 15:
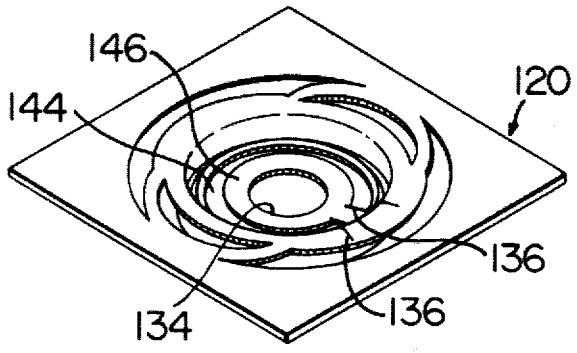

After the drawing step (FIG. 14), an arcuate slit 144 is formed at a position radially spaced a predetermined distance from the circular opening 134 formed by the punching step (FIG. 13) (slit-forming step, FIG. 15). In the illustrated embodiment, the slit 144 is an arcuate opening having a predetermined width which extends from the neighborhood of the inside end of one of the breaking weakened lines 136 to the vicinity of the inside end of the other breaking line 136 along the circular opening 134.

Figure 16:
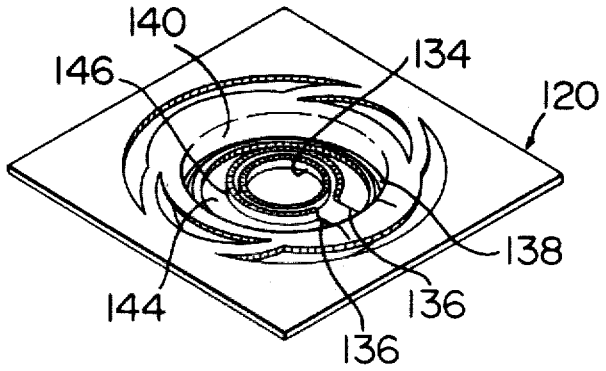
Figure 17:
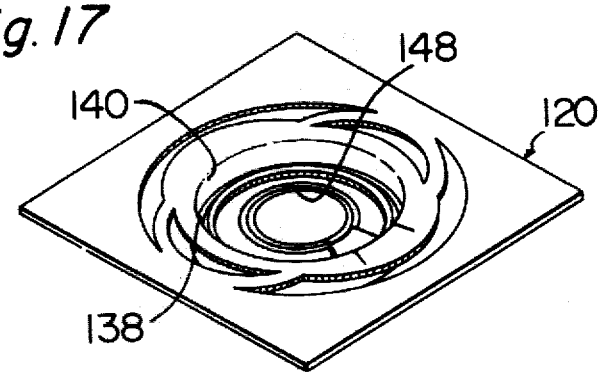

Subsequent to the slit-forming step (FIG. 15), the arcuate portion remaining between the circular opening 134 and the arcuate slit 144 is bended in a substantially U-shaped configuration (so that both leg portions of the U-shape may extend inwardly of the shell, i.e. upwardly in FIG. 16) (FIG. 16). Furthermore, the leg portions on both sides of the U-shaped portion are bent in a mutually approaching direction (FIG. 17). Thus, a pull ring 148 is formed which is generally arcuate or circular and has a cross section of a substantially ring shape or an elliptical shape (bending step).

Figure 18:
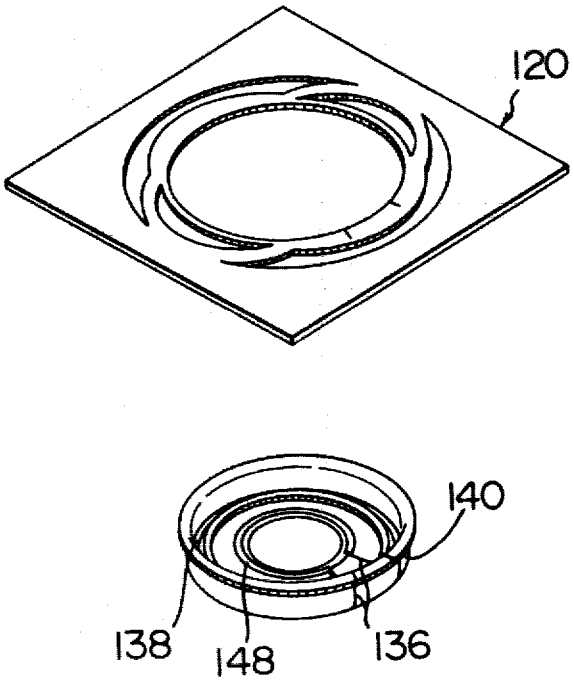

After the bending step (FIGS. 16 and 17), the shell is separated from the metal blank 120, for example at the marginal portion of the cylindrical skirt 140 of the shell (separating step, FIG. 18). Thus, a shell having the structure shown at the bottom of FIG. 18 is formed.

Figure 7:
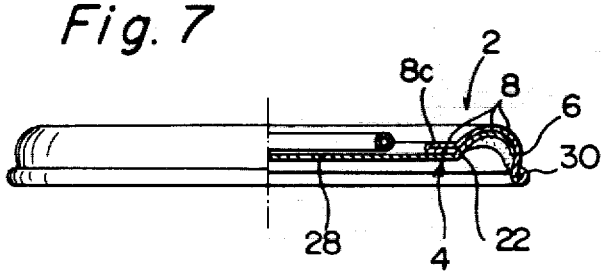
FIG. 7 is a partly sectional view of a third embodiment of the container closure in accordance with this invention.
Figure 19:
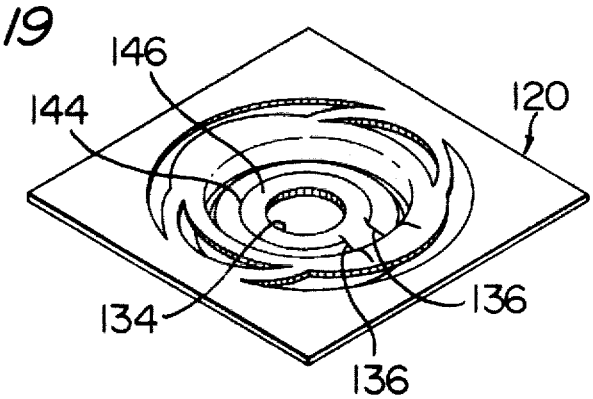
FIGS. 19 to 21 are perspective views showing steps which may be carried out in place of the steps shown in FIGS. 15 to 17.
Figure 20:
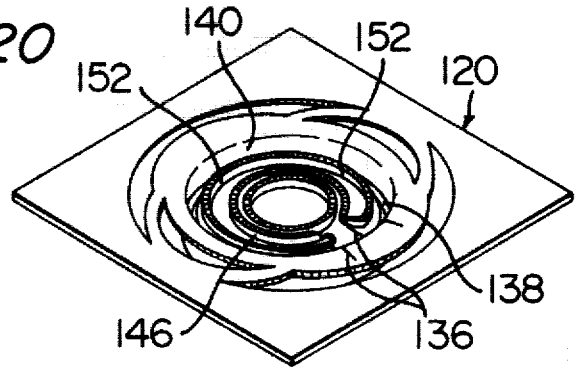
Figure 21:
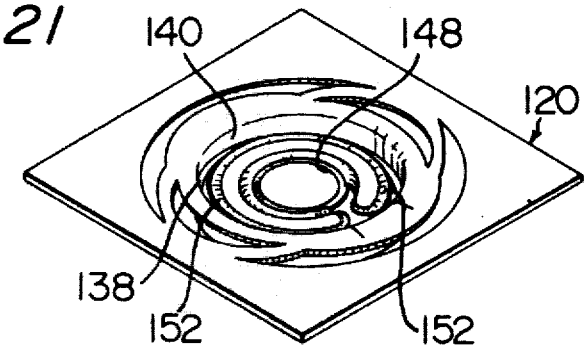

FIGS. 19 to 21 show steps which can be performed in place of the slit-forming step shown in FIG. 15 and the bending step shown in FIGS. 16 and 17 when as in the shell 2 shown in FIG. 7, the free edge portion of the inner peripheral edge 10 of the annular top portion 8 is desired to be curved downwardly and outwardly.

In the slit-forming step shown in FIG. 19 which is to be performed subsequent to the drawing step (FIG. 14), the arcuate slit 144 radially spaced a predetermined distance from the circular opening 134 formed by the punching step (FIG. 13) is formed by the incision of the blank in the form of a breaking line, and both ends of it are curved inwardly in the radial direction with a relatively small curvature and are connected tangentially to a pair of the breaking weakened lines 136.

In the bending step shown in FIG. 20 which follows the slit-forming step shown in FIG. 19, the arcuate portion 146 between the circular opening 134 and the slit 144 is bended in a substantially U-shaped configuration (so that leg portions on both sides of the U-shaped configuration may extend inwardly of the shell, i.e. upwardly in FIG. 20), and a portion 152 having the slit 144 as its inside free edge and extending with a predetermined width along the slit 144 is bended inwardly of the shell substantially at right angles. Then, as shown in FIG. 21, the leg portions on both sides of the substantially U-shaped portion between the circular opening 134 and the slit 144 are bent in a mutually approaching direction to form an arcuate pull ring 148 whose cross-section is substantially ring-shaped or elliptical. Also, the portion 152 is bent toward the circular top portion 130 of the shell.

After the bending step (FIGS. 20 and 21), the separating step described hereinabove with reference to FIG. 18 is carried out.

In the illustrated embodiment, the punching step (FIG. 13) and the breaking line-forming step (FIG. 13) are simultaneously carried out before the drawing step (FIG. 14). Alternatively, the punching step (FIG. 13) may be performed after the drawing step (FIG. 14) and before, during or after the slight-forming step (FIG. 15). Furthermore, the punching step (FIG. 13) may be performed before the drawing step (FIG. 14) and before or after the lance slit-forming step (FIGS. 11 and 12) and the breaking line-forming step (FIG. 13). In other words, the punching step (FIG. 13) can be carried out any time before the bending step (FIG. 16).

In the illustrated embodiment, the lance slit-forming step (FIGS. 11 and 12) is first carried out and then the breaking line-forming step (FIG. 13) is effected. However, before the drawing step (FIG. 14), these steps can be carried out simultaneously or in a reverse order.

In the illustrated embodiment, the generally arcuate or circular pull ring 148 is formed by forming the circular opening 134 and the arucate slit 144. If desired, the shapes of the opening and slit can be properly selected so as to form the pull ring in any other desired shape such as an ellipse, rectangle or hexagon. Furthermore, in the illustrated embodiment, the pull ring 148 is formed at the center of the circular top 138 of the shell. When the diameter of the circular top 138 is relatively large, the pull ring 148 may be formed eccentrically with respect to the circular top 138.

Furthermore, in the illustrated embodiment, a square metal blank having a dimension suitable for production of one shell is used. To perform the shell-producing step at high speeds and continuously, it is also possible to progressively feed a ribbon-like metal blank having a predetermined length or a continuous ribbon-like metal blank unwound from a metal blank coil to each of the steps, so that a number of outside shells may be produced successively from the ribbon-like metal blank. Alternatively, the width of the ribbon-like metal blank is adjusted to the one suitable for production of two or more shells, and to subject the blank to two or more lines of a set of the manufacturing steps.

Those skilled in the art can carry out each of the above steps by using known tools, and therefore, a description of these tools will be omitted in this specification.

Now, a press-forming device will be described below which can be suitably used to incline the skirt of the shell shown at the bottom of FIG. 18 inwardly toward the free end of the skirt and form a curl at the free end.

In the production of the shell of the easily openable container closure of this invention which has been described in detail with reference to FIGS. 1 to 10 above, it is often desired to incline the skirt inwardly toward its free end and to form a curl at the free end. It is the general practice to incline the free end of the skirt inwardly toward its free end and form a curl at the free end by rolling the skirt of the shell using a rotary inside rolling tool and a rotary outside rolling tool. This rolling method makes it possible to exactly incline the skirt inwardly toward its free end, and form a curl at the free end.

This method, however, has the defect that a relatively long period of time is required for the rolling operation, and a pair of rolling tools can process at most about 50 shells per minute. The above rolling method consists essentially of (1) fitting a shell to be processed in a rotating inside rolling tool, (2) then moving a rotating outside rolling tool toward the inside rolling tool to roll the skirt of the shell located between them by the cooperative action of the two rolling tools, and (3) then, moving the outside rolling tool away from the inside rolling tool, and taking out the processed shell from the inside rolling tool. Thus, this processing operation is comparatively time-consuming.

It has previously been thought that the use of a press-forming technique in the above processing operation is impossible because this operation involves inclining of the skirt of the shell toward its free end, and the detaching of the tool from the shell after processing. The present inventor has now found surprisingly that the application of the press-forming technique to a shell of the above structure makes it possible to incline the skirt of the shell toward its free end and form a curl at the free end exactly and within a relatively short period of time.

A preferred embodiment of the press-forming device in accordance with this invention is described below with reference to FIGS. 22 and 23-A to 23-D.

Figure 22:
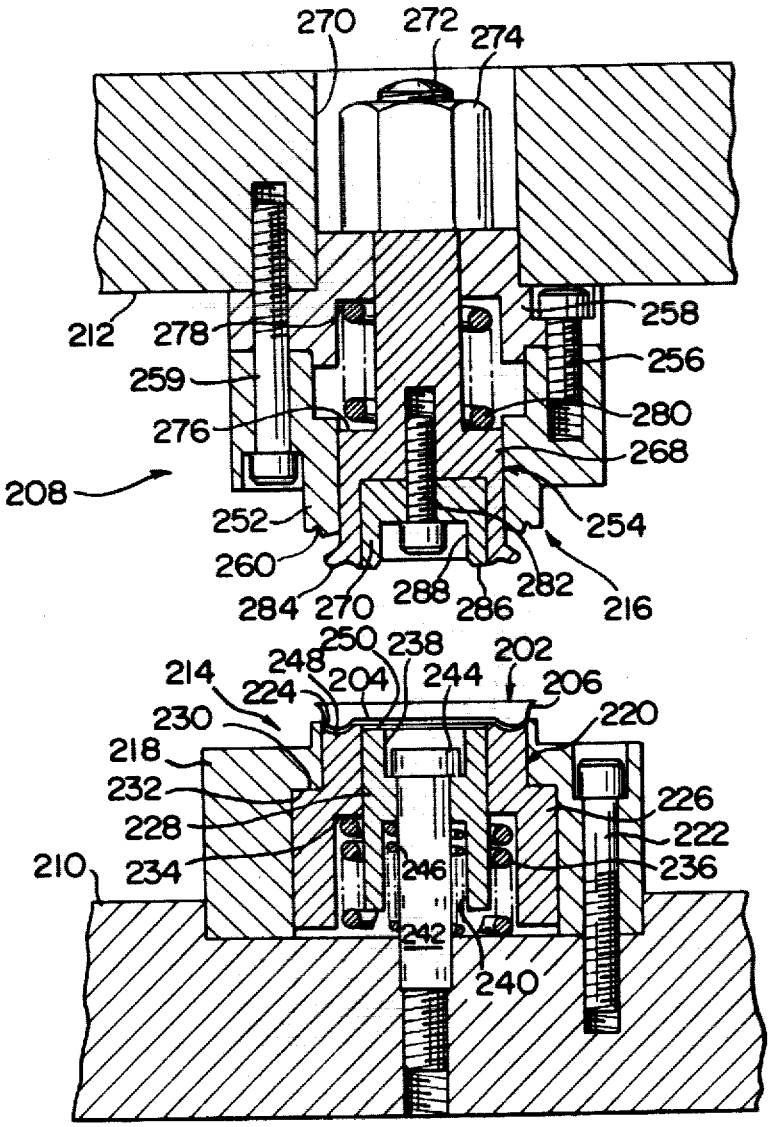
FIG. 22 is a sectional view of one embodiment of a press-forming device in accordance with this invention.

Referring mainly to FIG. 22, a shell 202 to be press-formed, for example the shell illustrated at the bottom of FIG. 18, has a circular top 204 and a cylindrical skirt 206, the free end of the cylindrical skirt 206 being curved somewhat outwardly.

A press-forming device shown generally at 208 for inclining the skirt 206 of the shell 202 inwardly toward its free end and forming a curl at the free end includes a pair of support plates 210 and 212 spaced from each other (in the embodiment shown, spaced from each other in the perpendicular direction). The support plates 210 and 212 are constructed such that at least one of them is freely movable toward and away from the other (in the illustrated embodiment, in the perpendicular direction), and they can be moved by a suitable known drive mechanism (not shown) such as a hydraulic drive mechanism or a jacktype drive mechanism containing an electric motor. In the illustrated embodiment, the upper support plate 212 is moved in the perpendicular direction, and therefore, the lower support plate 210 relatively moves toward and away from the upper support plate 212.

A first press tool assembly 214 is mounted on the lower support plate 210, and a second press tool assembly 216 is mounted on the upper support plate 212. When the upper support plate 212 moves toward the lower support plate 210, the first and second press tool assemblies 214 and 216 act cooperatively to press-form the shell 202 therebetween as desired.

The first press tool assembly 214 includes a first tool 218 and a second tool 220. The first tool 218 is of a substantially hollow cylindrical shape and is fixed to the upper surface of the support plate 210 by a suitable means such as a clamping bolt 222. Its upper end portion on the inside surface in the radial direction has an annular engaging surface 224 facing inwardly in the direction of its inside diameter. As will be described in detail below, this annular engaging surface 224 comes into engagement with at least a part of the outside surface of the skirt 206 of the shell 222 during the press-forming of the shell 202.

The second tool 220 is formed of two portions, i.e. an outside portion 226 and an inside portion 228, in the embodiment illustrated. The outside portion 226 is of a substantially hollow cylindrical shape, and is disposed inwardly of the first tool 218. The outside portion 226 is adapted to slide in the direction of the relative movement of a pair of support plates 210 and 212 in the perpendicular direction between the position (the position shown in FIG. 22) at which an annular shoulder portion 230 formed on the outside surface of the outside portion 226 in the radial direction makes contact with an annular shoulder portion 232 formed on the inside surface of the first tool 218 in the radial direction and the position (the position shown in FIG. 23-D) at which the lower surface of the outside portion 226 makes contact with the upper surface of the support plate 210. The outside portion 226 also has an annular shoulder portion 234 formed on its inside surface in the radial direction, and a compression spring 236 is interposed between the annular shoulder portion 234 and the upper surface of the support plate 210. The compression spring 236 urges the outside portion 226 in the perpendicular direction, namely toward the upper support plate 212, and elastically holds the outside portion 226 at the position (the position shown in FIG. 22) at which the shoulder portion 230 registers with the shoulder portion 232 of the first tool 218.

The inside portion 228 of the second tool 220 is a substantially cylindrical portion having a recess 238 formed at its upper surface and a recess 240 formed at its undersurface, and is disposed inwardly of the outside portion 226. The inside portion 228 has a through-hole formed centrally thereof which extends from the bottom surface of the recess 238 to the bottom surface of the recess 240, and a bolt 242 is screwed to the support plate 210 through this hole. The inside portion 228 is adapted to slide in the direction of the relative movement of the support plates 210 and 212 between the position (the position shown in FIGS. 22 and 23-A) at which the bottom surface of the recess 238 makes contact with a head portion 244 of the bolt 242 and the position at which the bottom surface of the inside portion 228 makes contact with the upper surface of the support plate 210. A compression spring 246 is interposed between the bottom surface of the recess 240 and the upper surface of the support plate 210. The compression spring 246 urges the inside portion 228 toward the upper support plate 212, and elastically holds the inside portion 228 at the position (shown in FIG. 22) at which the bottom surface of the recess 238 makes contact with the head portion 244 of the bolt 242.

The annular top surface of the outside portion 226 of the second tool 220 has a shape corresponding to the outside surface of the peripheral portion of the top portion 204 of the shell 202 (therefore, when the shell 202 is of the shape illustrated at the bottom of FIG. 18, the outside surface of the peripheral portion corresponds to the annular top surface of the top, and as will be described hereinbelow, forms an engaging surface 248 which comes into engagement with the outside surface of the peripheral portion of the top portion 204 of the shell 202 when the shell 202 is subjected to press forming ). Likewise, the annular top surface of the inside portion 228 of the second tool 220 has a shape corresponding to the shape of the outside surface of the top portion 204 of the shell 202, and as will be described in detail below, forms an engaging surface 250 which comes into engagement with the outside surface of the top 204 of the shell 202 when the shell 202 is subjected to press forming. When the shell 202 is of the shape illustrated at the bottom of FIG. 18, the recess 238 formed on the upper surface of the inside portion 228 is positioned correspondingly to the position of the pull ring 202 (FIG. 23-A) formed on the top 204, so that during the press forming of the shell 202, the tool may not contact the pull ring 205 to adversely affect its shape.

The second press tool assembly 216 mounted on the upper support plate 212 includes a third tool 252 and a fourth tool 254.

The third tool 252 is of a substantially hollow cylindrical shape, and fixed to the lower surface of the undersurface of the support plate 212 by a suitable means such as a bolt 259 through an annular fixing plate 258 secured to the upper surface of the third tool 252 by a suitable means such as a bolt 256. The third tool 252 further has an annular engaging recess 260 provided at its undersurface which recess will form a curl upon engagement with the free end of the skirt 206 of the shell 202 during the press-forming of the shell 202. As clearly shown in FIG. 23-A, the annular engaging recess 260 is defined by an annular inside surface 262 facing outwardly in the radial direction, an annular outside surface 264 facing inwardly in the radial direction, and an annular bottom surface 266 facing toward the lower support plate 210.

In the illustrated embodiment, the fourth tool 254 is formed of an outside portion 268 and an inside portion 270. The outside portion 268 disposed inwardly of the third tool 252 has an upper extension 272 which extends through the hole formed in the central part of the annular fixing plate 258 and projecting into a hole 270 formed in the support plate 212. A nut 274 having a larger size than the through-hole formed in the annular fixing plate 258 is screwed to the extension 272. Hence, the outside portion 268 cannot slide downward in the perpendicular direction from the position (the position shown in FIG. 22) at which the nut 274 contacts the upper surface of the annular fixing plate 258, but can slide over a predetermined distance upwardly in the perpendicular direction from this position. In other words, the outside portion 268 is mounted such that it can slide over a predetermined range in the direction of the relative movement of the support plates 210 and 212.

An annular shoulder portion 276 is formed on the outside surface of the outside portion 268 in the radial direction, and a compression spring 280 is interposed between the annular shoulder portion 276 and the annular shoulder portion 278 formed on the undersurface of the annular fixing plate 258. The compression spring 280 urges the outside portion 268 toward the lower support plate 210, and elastically holds the outside portion 268 at the position (the position shown in FIG. 22) at which the nut 274 makes contact with the upper surface of the annular fixing plate 258.

The inside portion 270 is fixed in a recess formed centrally in the undersurface of the outside portion 268 by a suitable means such as a bolt 282. The outer peripheral portion of the undersurface of the outside surface 268 of the fourth tool is of a shape corresponding to the shape of the inside surface of the peripheral portion of the top of the shell 202, and as will be described in detail hereinbelow, has an engaging surface 284 formed thereon which comes into engagement with the inside surface of the top 204 of the shell at the inside of the engaging surface 284. The recess 288 formed centrally in the inside portion 270 is positioned correspondingly to the position of the pull ring 205 (FIG. 23-A) formed in the top 204 when the shell 202 is of the shape shown at the bottom of FIG. 18, so that during the press forming of the shell 202, the press-forming tool may not contact the pull ring 205 to adversely affect its shape.

When the press-forming device 208 described hereinabove is used, the skirt 206 of the shell is subjected to press-forming by the cooperative action of the first tool assembly 214 and the second tool assembly 216, more specifically by the cooperative action of the annular engaging surface 224 of the first tool 218 and the annular engaging recess 260 of the third tool 252. At this time, it is important that to incline the skirt 206 inwardly toward its free end, the annular inside surface 262 of the annular engaging recess 260 of the first tool 218 should be inclined in the radial direction inwardly of the annular engaging surface 224 of the first tool 218 by a dimension l which is larger than the thickness of the skirt 206. As will be made clear from the following description, the degree of inclination of the skirt 206 in the press-formed shell 202 depends upon the dimension l.

In the press-forming operation by the press-forming device 208 described hereinabove, the fourth tool 254 is located within the shell 202 should be exactly removed from the shell 202 after the press-forming operation without causing any inconvenience (for example, without the tool 254 coming into engagement with the skirt 206 inclined inwardly toward its free end and turning it outwardly). To achieve this, it is important that in the illustrated embodiment, the peripheral edge of the engaging surface 284 of the fourth tool 254 and a side surface following the peripheral edge should be located at substantially the same position in the radial direction as the annular inside surface 262 of the third tool 252, or inwardly thereof by some dimension m (FIG. 23-D). If the dimension m is too large, the engaging surface 284 of the fourth tool 254 comes into engagement with the top 204 at a position considerably inwardly of the peripheral edge of the top 204 during the press-forming of the shell 202, and therefore, at the time of press-forming the skirt 206 of the shell 202, buckling tends to occur in the skirt 206. It is preferred therefore that the above dimension m should be substantially 0, or very small (for example, about 0.1 to 0.5 mm).

Now, with reference to FIGS. 22 and 23-A to 23-D, the operation and advantage of the press-forming device 208 will be described.

When the shell 202 having the circular top 204 and the skirt 206 is to be press-formed, a pair of support plates 210 and 212 are set apart as shown in FIG. 22 to make the first press tool assembly 214 and the second press tool assembly 216 separate from each other. The shell 202 is then put on a predetermined position of the first press tool assembly 214 by hand or by a suitable automated supply mechanism (not shown) so that the outside surface of the peripheral portion of the top 204 of the shell 202 is supported by the engaging surfaces 248 and 250 of the outside portion 226 and the inside portion 228 of the second tool 220 of the press tool assembly 214.

Then, the upper support plate 212 is moved downwardly in the perpendicular direction to move the second press tool assembly 216 toward the first press tool assembly 214. Then, as shown in FIG. 23-A, the engaging surfaces 284 and 286 of the second press tool assembly 216 come into engagement with the inner surface of the peripheral portion of the top 204 of the shell 202, and therefore, the peripheral portion of the top 204 is held between the engaging surfaces 248 and 250 of the second tool 220 and the engaging surfaces 284 and 286 of the fourth tool 254. The second tool 220 is elastically urged upwardly in the perpendicular direction by the action of the compression springs 236 and 246, and the fourth tool 254 is elastically urged downwardly in the perpendicular direction by the action of the compression spring 280. Accordingly, the peripheral portion of the top 204 of the shell 202 is elastically held between the second and fourth tools 220 and 254. Even when the upper support plate 212 continues to move downwardly in the perpendicular direction and the second press tool assembly 216 further approaches the first press tool assembly 214, the second tool 220 and the fourth tool 254 are moved in the perpendicular direction against the urging force of the compression springs 236, 246 and 280, and their relative positions are maintained constant. Therefore, the peripheral portion of the top 204 of the shell 202 is simply kept elastically held between the second and fourth tools 220 and 254. The top 204 of the shell 202 is not substantially deformed plastically by the cooperative action of the second tool 220 and the fourth tool 254.

When the second press tool assembly 216 approaches the first press tool assembly 214 to the extent shown in FIG. 23-A, and the top 204 of the shell 202 is elastically held between the second and fourth tools 220 and 254, the free end portion of the skirt 206 of the shell 202 is positioned in the annular engaging recess 260 formed in the third tool 252 of the second press tool assembly 216, as shown clearly in FIG. 23-A.

When the upper support plate 212 continues to move downwardly in the perpendicular direction, and the second press tool assembly 216 approaches the first press tool assembly 214, the annular engaging surface 224 formed in the first tool 218 and facing inwardly in the radial direction comes into engagement with the outside surface of the skirt 206 of the shell 202 (FIGS. 23-B, 23-C and 23-D) to incline the skirt 206 inwardly toward its free end by the amount corresponding to the dimension l in the radial direction between the annular engaging surface 224 and the annular inside surface 262 of the annular engaging recess 260 of the third tool 252 (FIG. 23-D). Simultaneously, the annular inside surface 262, the annular bottom surface 266 and the annular outside surface 264 of the annular engaging recess 262 of the third tool 252 come into engagement with the free end of the skirt 206 to curve the free end of the skirt 206 gradually outwardly and transform it into an outwardly facing curl having a shape corresponding to the shape of the annular engaging recess 260, as shown in FIGS. 23-B, 23-C and 23-D.

When in the process shown in FIGS. 23-B, 23-C and 23-D, the dimension m in the radial direction between the annular inside surface 262 of the annular engaging recess 260 formed in the third tool 252 and the peripheral edge of the engaging surface 284 of the fourth tool 268 (FIG. 23-D) is relatively large, buckling is likely to occur in the skirt 206, especially near the boundary between the top 204 and the skirt 206. Hence, as already stated hereinabove, the dimension m should be substantially zero or very small.

When the second press tool assembly 216 has been caused to approach the first press tool assembly 214 to the extent shown in FIG. 23-D to incline the skirt 206 of the shell 202 inwardly toward its free end, and form a curl at the free end of the skirt 206, the downward movement of the upper support plate 212 is stopped by a suitable control means (not shown) including a detector such as a limit switch capable of detecting the position of the upper support plate 212. Then, the upper support plate 212 is moved upwardly in the perpendicular direction, and the second press tool assembly 216 is moved away from the first press tool assembly 214. When the second press tool assembly 216 departs from the first press tool assembly 214, the peripheral edge of the engaging surface 284 of the outside portion 268 of the fourth tool 254 and a side surface following the peripheral edge are positioned at substantially the same position in the radial direction as the annular inside surface 263 of the annular engaging recess 260, or inwardly thereof by some distance m, and therefore, they are positioned at substantially the same position in the radial direction as the innermost surface of the skirt 206 inclined inwardly toward its free end, or inwardly thereof by some distance m. Accordingly, the fourth tool positioned inwardly of the shell can be surely removed from the inside of the shell 202 without any adverse effect on the press-formed shell 202.

When the upper support plate 212 has been moved over a sufficient distance upwardly in the perpendicular direction, and the second press tool assembly 216 has moved away over a sufficient distance from the press-formed shell 202 and the first press tool assembly 214, the outside portion 226 and the inside portion 228 of the second tool 220 of the first press tool assembly 214 are returned to the positions shown in FIG. 22 by the urging action of the compression springs 236 and 246. Accordingly, the press-formed shell 202 is in the same relation to the first press tool assembly 214 as to the shell 202 shown in FIG. 22, and it can be easily and rapidly taken out of the press-forming device 208 by hand or by a suitable mechanism (not shown).

Experience of the present inventor tells that by using the press-forming device 208 described hereinabove, 100 or more shells can be accurately processed for each set of press tool assemblies 214 and 216.

In the illustrated embodiment, the free end of the skirt 206 of the shell 202 to be processed is somewhat outwardly curved, and an outwardly facing curl is formed in the free end of the skirt 206. Alternatively, the free end of the skirt 206 may be curved somewhat inwardly, and by press forming, an inwardly facing curl may be formed in the free end of the skirt 206.

Furthermore, in the illustrated embodiment, the second tool 220 of the first press tool assembly 214 is composed of two portions, i.e. the outside portion 226 and the inside portion 228, and the fourth tool 254 of the second press tool assembly 216 is composed of two portions, i.e. the outside portion 268 and the inside portion 270. If desired, the second tool 220 and the fourth tool 254 may each be formed from a single piece.

In the illustrated embodiment, the engagement of the second and fourth tools with the pull ring 205 formed centrally in the top 204 of the shell 202 is prevented during the press-forming operation by providing the recess 238 in the center of the upper surface of the inside portion 228 of the second tool 220 and the recess 288 in the central part of the undersurface of the fourth tool 254. However, when the shell 202 to be processed does not have a pull ring or the engagement of the tools with the pull ring during the press forming operation is not likely to affect the pull ring, the provision of the recesses 238 and 288 can, of course, be omitted.

Furthermore, in the illustrated embodiment, a pair of press tool assemblies 214 and 216 are mounted on a pair of supporting plates 210 and 212. Alternatively, it is possible to mount multiple pairs of press tools assemblies, and to press-form a plurality of shells 202 between multiple pairs of press tool assemblies by the relative movement of a pair of the support plates 210 and 212.

What we claim is:

1. A method for producing a shell of a unitary structure comprising a top and a cylindrical skirt, said top having an annular top surface portion leading to the upper end of said skirt and a linking piece leading to a part of the inner peripheral edge of the annular top surface portion, a pull ring connected to said linking piece, said annular top surface portion and skirt having a pair of weakening lines extending from both side edges of said linking piece, which method comprises:

(a) forming at least one set of lance slits in a flat metal blank, said lance slits having at least two discontinuous portions spaced a predetermined distance from each other in the circumferential direction, (b) forming a pair of weakening lines spaced from each other at a predetermined distance in the circumferential direction, said weakening lines extending over a predetermined distance from near the lance slits toward the center of a circular portion of the blank located inwardly of the lance slits, (c) punching out an opening of a predetermined dimension in the circular portion at a position located inwardly of the lance slits, (d) at least after the lance slit-forming step (a) and the weakening line-forming step (b), drawing the circular portion located inwardly of the lance slits to form a shell having a circular top with said opening therein and a substantially cylindrical skirt continuous therewith, (e) at least after the drawing step (d), forming a slit in said circular top extending around said opening from near the inside end of one of said weakening lines to the vicinity of the inside end of the other weakening line, said slit being spaced a predetermined distance outwardly from said opening in the radial direction, (f) after the punching step (c) and the slit-forming step (e), bending the portion between said opening of the circular top and the slit to form a pull ring, and (g) after the bending step (f), separating the thus formed shell from the metal blank.

2. The method of claim 1 wherein the punching step (c) is carried out before the drawing step (d).

3. The method of claim 1 wherein the punching step (c) is carried out after the drawing step (d).

4. The method of claim 1, 2 or 3 wherein in the slit-forming step (e), the slit is formed by punching the blank in the form of an opening having a predetermined width.

5. The method of claim 1, 2 or 3 wherein in the slit-forming step (e), the slit is formed by incising the blank in the form of a cutting line, and in the bending step (f), a portion having the slit of the circular top portion as an inside free end and extending with a predetermined width along the slit is bent inwardly of the shell.

* * * * *